US006155022A

United States Patent [19]

DeCanio et al.

[11] Patent Number: 6,155,022

[45] Date of Patent: Dec. 5, 2000

[54] SHIELDING PANEL REMOVAL AND INSTALLATION SYSTEM FOR SUPPORTLESS DASHER BOARDS

[75] Inventors: Gary DeCanio, East Setauket; Paul J. DeCanio, Brentwood, both of N.Y.; Bruce W. Irving, Brampton, Canada

[73] Assignee: Athletica, Inc., Minneapolis, Minn.

[21] Appl. No.: 09/207,561

[22] Filed: Dec. 8, 1998

Related U.S. Application Data

[60] Provisional application No. 60/069,117, Dec. 9, 1997.

[51] Int. Cl.[7] ..... E04B 1/61

[52] U.S. Cl. ..... 52/766; 52/127.11; 52/126.1; 256/24; 256/26

[58] Field of Search ..... 52/122.1, 126.1, 52/127.11, 204.64, 766, 768, 800.18; 256/24, 25, 65; 403/79; 472/92, 94

[56] References Cited

U.S. PATENT DOCUMENTS

| | | | |
|---|---|---|---|
| 3,072,975 | 1/1963 | Burnmeister | 49/317 |
| 3,844,539 | 10/1974 | Abbott | 256/25 |
| 4,450,658 | 5/1984 | Legeai | 52/242 |
| 4,454,690 | 6/1984 | Dixon | 52/126.3 |
| 4,808,023 | 2/1989 | Arnold | 403/79 |
| 4,883,267 | 11/1989 | Burley | 256/24 |
| 4,927,134 | 5/1990 | Burley | 256/25 |
| 5,159,793 | 11/1992 | Deugo | 52/126.1 |
| 5,364,076 | 11/1994 | Nicholls | 256/24 |
| 5,706,625 | 1/1998 | Vallance | 52/766 |
| 5,863,030 | 1/1999 | Kotler | 256/24 |
| 5,953,882 | 9/1999 | Vallance | 52/766 |
| 6,004,217 | 12/1999 | Johnston | 472/92 |

*Primary Examiner*—Carl D. Friedman
*Assistant Examiner*—Kevin McDermott
*Attorney, Agent, or Firm*—Greenberg Traurig, LLP; Anthony R. Barkume

[57] ABSTRACT

A semi-automatic shielding panel removal and installation system for supportless dasher board systems. A U-channel runs along the length of a dasher board for holding in place (by cam means) a shielding panel. The U-channel is divided into two portions; a fixed portion is mounted to the frame of the dasher board, and a movable portion is able to be lifted off of a stringer by an actuator device. During normal use of the dasher board system (i.e. during a hockey game), the cam means holds the shielding panel snugly within the U-channel portions. When it is desired to remove the panel, a motor-driven lifting device is pivotably attached to the movable portion of the U-channel and actuated. The movable portion of the U-channel is lifted vertically, thus lifting the panel out of and away from the fixed portion of the U-channel. When the top portion of the dasher board has been cleared, the U-channel is rotated by 90 degrees so the panel may be slid out and loaded onto a skid or other storage means. The reinstallation process of the panel is the reverse of the removal process.

12 Claims, 9 Drawing Sheets

SHIELDING PANEL REMOVAL AND INSTALLATION SYSTEM FOR SUPPORTLESS DASHER BOARDS

CROSS-REFERENCE TO RELATED APLICATIONS

This application claims priority from co-pending U.S. provisional patent application Ser. No. 60/069,117, which was filed on Dec. 9, 1997, and which is incorporated by reference herein.

BACKGROUND OF THE INVENTION

This invention relates generally to dasher board systems, and in particular to a system for semi-automatically removing and installing shielding panels from a supportless dasher board.

Dasher board systems utilized typically in ice hockey rinks comprise a plurality of dasher boards, or frames, each used to house and support a corresponding shielding panel, which is typically made of transparent tempered glass. In particular, an existing dasher board system marketed by Crystaplex Arenas as the 5000 Series Hockey Dasher Boards consist of an aluminum frame covered with polyethylene, made in demountable sections approximately 42" high and 96" long. The top of the frame has a 3½" to 4½" deep U-channel that supports the tempered glass or shielding panel.

The glass extends up from the U-channel in the boards to protect the spectators and to keep the puck in play. The bottom of the glass has a rubber-like gasket to protect it from contacting directly the U-channel. This type of system is disclosed in U.S. Pat. No. 5,706,625, which is incorporated by reference herein.

This type of supportless dasher board system is used in many major hockey arenas. These arenas are not dedicated to hockey, and there is accordingly the need to often remove the glass and the dasher boards or just remove the glass for other events. The glass and boards are then reinstalled for hockey. This time and labor to do this is of concern.

Existing methods of removing and reinstalling the tempered glass are rather primitive. The size and weight of the glass and the need to protect it from breakage dictates how the glass can be handled. To remove the glass, the glass must be raised vertically out of the U-channel. It can then be placed on a storage cart or skid and placed in storage. Two typical methods currently in use are:

a. Three or four people can manually remove or reinstall the glass.

b. Suction cup holders can be attached to the glass and raised with a fork lift truck, which still necessitates two or three people.

To reinstall, the glass must be placed vertically and set down into the U-channel. Again, this can be done manually with three or four people or with the aid of a fork lift truck.

Therefore, there is a need for a system and method of reducing the time and labor to do this change-over.

SUMMARY OF THE INVENTION

The present invention is a dasher board system comprising a dasher board frame assembly, a channel assembly for receiving a shielding panel, the channel assembly comprising a movable channel aligned for holding the shielding panel therewithin, and means for lifting the movable channel, so that a shielding panel held within the channel assembly will be lifted along with the movable channel. The means for lifting the movable channel is pivotably joined to the movable channel, so that the movable channel may be rotated with respect to the dasher board assembly when the shielding panel has been completely lifted out of the dasher board assembly.

The channel assembly may also comprise a fixed channel affixed to the dasher board frame assembly and comprising means for releasably clamping the shielding panel therewithin, so that the movable channel is aligned with the fixed channel so as to provide a substantially contiguous channel assembly for holding the shielding panel therewithin.

Preferably, the means for lifting the movable channel is pivotably joined to the movable channel by a pivoting assembly comprising a clevis assembly located on an underside portion of the movable channel, a swivel eye located on an upper portion of the means for lifting the movable channel, and a pin inserted through an axis formed by the alignment of the clevis assembly and the swivel eye.

The means for lifting the movable channel is selectively removable from the dasher board assembly. The dasher board frame assembly comprises an intermediate stringer extending laterally therealong, and the means for lifting the movable channel has a substantially C-shaped frame portion for removable placement on the intermediate stringer.

The means for lifting the movable channel comprises a motor and a pair of actuator assemblies interconnected thereto, each of the actuator assemblies comprising an extendable shaft having a retracted position substantially contained within the actuator and an extended position, the motor interacting with the actuators to selectively drive the extendable shaft between the retracted position and the extended position, the actuators comprising the swivel eye at an end thereof.

In accordance with the present invention, provided is a method for removing a shielding panel from a dasher board assembly, the shielding panel being located partially within a movable channel, the method comprising the steps of locating a lifting device against a portion of the dasher board assembly, pivotably joining an upper portion of the lifting device to a lower portion of the movable channel, engaging a drive mechanism to cause the lifting mechanism to extend upwardly, allowing the movable channel to carry the shielding panel substantially out of the dasher board assembly, pivoting the shielding panel and movable channel with respect to the dasher board assembly, and removing the shielding panel from the movable channel when the shielding panel is substantially horizontal to the ground.

Likewise, provided is a method for installing a shielding panel into a dasher board assembly comprising the steps of locating a retracting device against a portion of the dasher board assembly, pivotably joining an upper portion of the retracting device to a lower portion of a movable channel, engaging a drive mechanism to cause a retracting mechanism to extend upwardly, allowing the movable channel to extend substantially out of the dasher board assembly, pivoting the movable channel with respect to the dasher board assembly, installing the shielding panel into the movable channel when the shielding panel is substantially horizontal to the ground, pivoting the movable channel and shielding panel with respect to the dasher board assembly into an upright position, reversing the drive of the drive mechanism to cause the retracting mechanism to retract, stopping the drive mechanism when the retracting mechanism has substantially retracted and the shielding panel is in desired alignment, and removing the retracting device from the dasher board assembly.

BRIEF DESCRIPTION OF THE DRAWING

FIGS. 4*a* through 9 are a sequence of elevational views from the spectator side showing the glass removal; wherein FIGS. 4*a* and 4*b* show the dasher boards in use, glass in place;

FIG. 9 shows the U-channel replaced into the dasher boards and the portable glass lifting device is removed.

DETAILED DESCRIPTION OF THE PREFERRED EMBODIMENT

Figure 1:
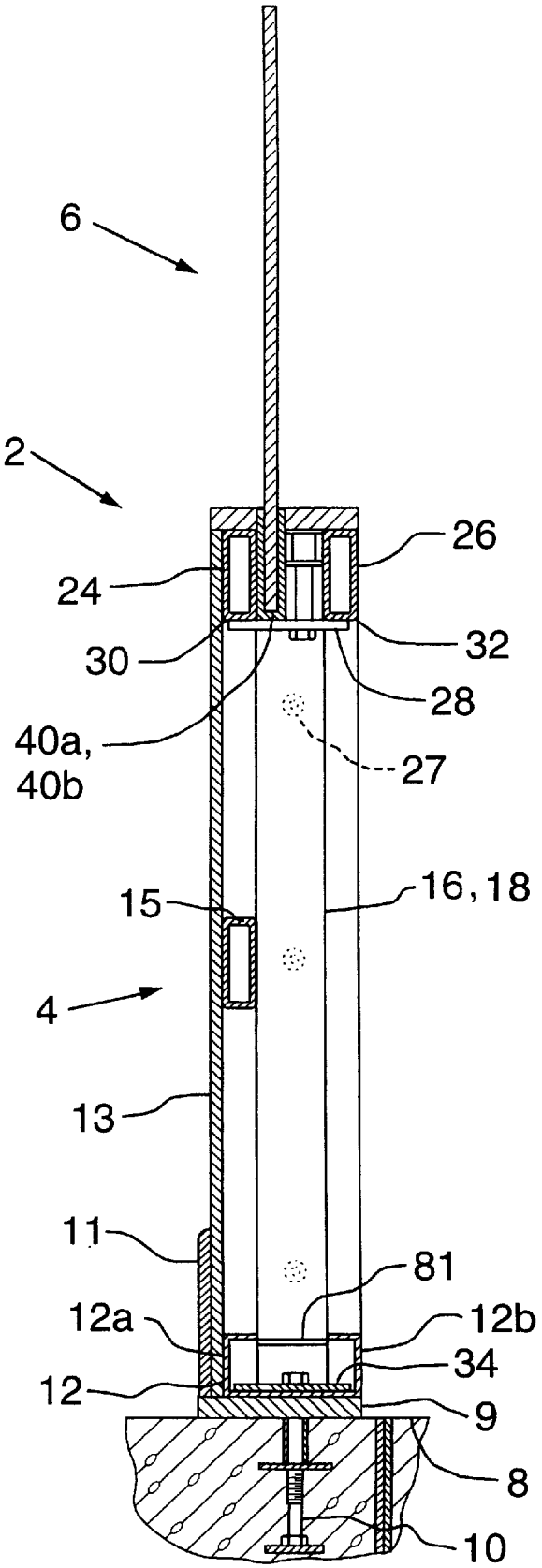
FIG. 1 is a side elevational view of the dasher board assembly.

FIG. 1 illustrates a side elevational view of a dasher board assembly of the prior art that has been modified in accordance with the present invention as described herein. The dasher board assembly of FIG. 1 is fully described in U.S. Pat. No. 5,706,625, which is owned by the assignee of the present invention, and which is incorporated by reference herein.

Figure 2:
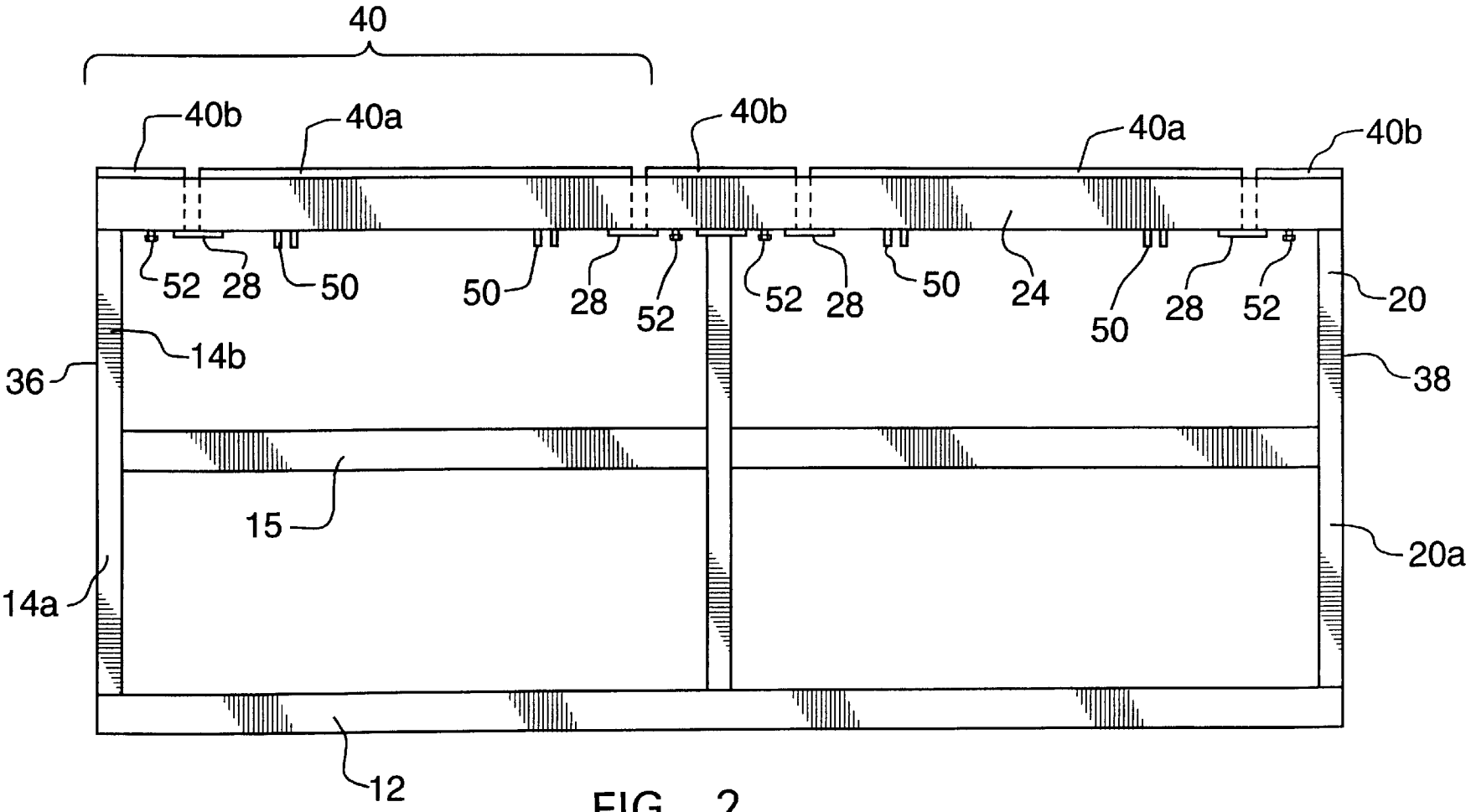
FIG. 2 is an elevation view of the dasher board system of FIG. 1 from the spectator side, without the glass or polyethylene.

FIGS. 1 and 2 illustrate the dasher board assembly 2 having a lower frame assembly 4 and shielding panel, such as tempered glass, or the like, 6. Tempered glass utilized in hockey rinks can have a variety of appropriate thicknesses such as for example ⅝ of an inch thick.

The dasher board assemblies are anchored to the ground by means of bolts 10 as well as to each other in side-by-side relation so as to define a hockey rink or the like in a manner to be more fully described herein. The dasher board assembly 2 is supportless in the sense that adjacent vertical side edges of the tempered glass 6 are permitted to abut one against the other.

In particular, the lower frame assembly 4 comprises a bottom channel 12 having a plurality of posts 16 and 18, whereby the lower ends of the posts 16 and 18 are connected or welded to the lower base plate or channel 12. The upper ends of the posts 16 and 18 are connected to the top stringers 24 and 26. In particular, the upper ends of the posts 16 and 18 are welded to flat plates 28 which in turn are welded to the bottom surface 30 and 32 of stringers 24 and 26. The stringers may be made from any suitable material such as for example out of aluminum tube or the like.

Although the size and configuration of the various components of the bottom frame can be varied within the spirit of the invention described herein, an example of the size and configurations of the various components shall now be given by way of example only without limiting the scope of the claims. The stringers 24 and 26 may be of any suitable size and for example are one and one-half inches by four inches by 3/16 of an inch thick aluminum. The flat plates 28 are also suitably sized and for example are one-half inch thick by five inches wide aluminum flat bar and can be eight inches long over the posts or six inches long between the posts. Alternatively flat plate 28 may be one piece.

For example, the bottom may comprise a pair of aluminum channels 12*a*, 12*b* each having dimensions of one and one-half inches by three inches by ninety-five and one-quarter inches long. A kick strip 11 is also provided adding protection to the bottom of the dasher board 2 against skates or the like. The kick strip may be comprised of a variety of materials such as for example plastic.

Moreover, the bottom 12 includes a plurality of anchor plates 34 adapted to receive bolts 10 for anchoring the dasher board system 2 into the ground or concrete 8. A polyethylene ice dam 9 is provided between the concrete floor 8 and bottom channels 12*a* and 12*b*. The dasher board also includes a plastic panel 13 fastened to the stringer 24 intermediate stringer and channel 12*a*; and in one example the plastic panel is one-half inch thick, and is white with red and blue markings as may be found in a hockey arena.

The dasher board 2 also includes an intermediate stringer 15 welded to the posts 16 and 18 and in one example stringer 15 may be made from one and one-half inch by three inches by one-eighth inch thick aluminum tube.

The dasher board 2 also includes plates 14*a*, 14*b* and 20 and 20*a* at each end, which are welded to the stringers 24, 26 and 15. Plates 14*a*, 14*b*, 20 and 20*a* can be made from appropriate materials such as aluminum and in one example are 3/16 inch thick by one and one-half inches wide and fifteen inches long and are adapted for fastening panel 13.

The dasher board system 2 also includes at the opposite sides thereof a plate 36 and 38 at each end thereof, which are welded to the stringers 24 and 26 and bottom 12. By way of example the side plates 36 and 38 may be comprised of one-quarter inch thick aluminum plate at each end of the panel, having a plurality of holes 27 adapted to receive bolts or fastening means (not shown) so as to fastened adjacent side by side dasher board systems so as to define an athletic enclosure. The side plates of 36 and 38 include a slot adapted to receive the end of the tempered glass 6.

Although the material defined herein can be comprised of a variety of materials, aluminum has been found to be particularly useful in that it is lightweight and strong and may be easily welded and is given by way of example only without limiting the scope of the claims.

The flat plate 28 is welded to the bottom of the stringers 24 and 26 and U-shaped channel 40. The U-shaped channel 40 comprises a movable U-channel 40*a* and a fixed U-channel 40*b*, is adapted to receive the tempered glass 6. In the prior art '625 patent, the U-channel 40 was a unitary assembly that extended substantially along the entire length of the dasher board assembly 2. The prior art U-channel 40 has been modified by the present invention to constituent assemblies 40*a* and 40*b* so the glass removal system may be implemented as described below.

As shown in FIG. 2, which is an elevational view from the spectator side with the polyethylene facing and top sill not shown for clarity, the fixed U-channel assembly 40*b* is fixed to the dasher board assembly to hold the glass 6 in place for normal use (i.e. playing hockey), and the movable U-channel 40*a* is movable in order to raise and lower the glass 6 as required. FIG. 2 also illustrates the location of a pair of clevises 50 that are fixed to each movable U-channel 40*a*. These clevises 50 will be used to pivotably connect to the portable glass lifting device 60 (shown in FIGS. 3*a* and 3*b*). Also shown in FIG. 2 are cams 52, which as more fully described in the '625 patent are used to clamp the fixed U-channel 40*b* around the glass 6 for securing the glass during play. Thus, when the glass is to be fixed in place, the cams 52 are biased, and when the glass is to be removed, the cams 52 are positioned in their unbiased or released state.

Figure 3A:
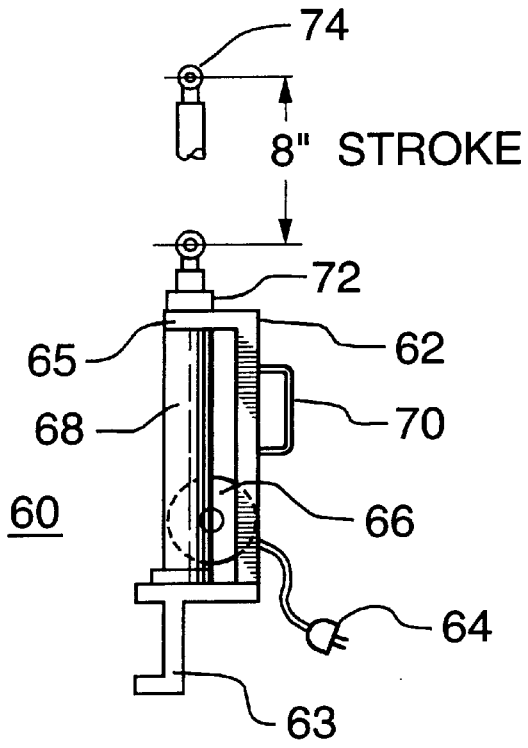
FIGS. 3*a* and 3*b* illustrate a general outline of the portable glass lifting device of the present invention.
Figure 3B:
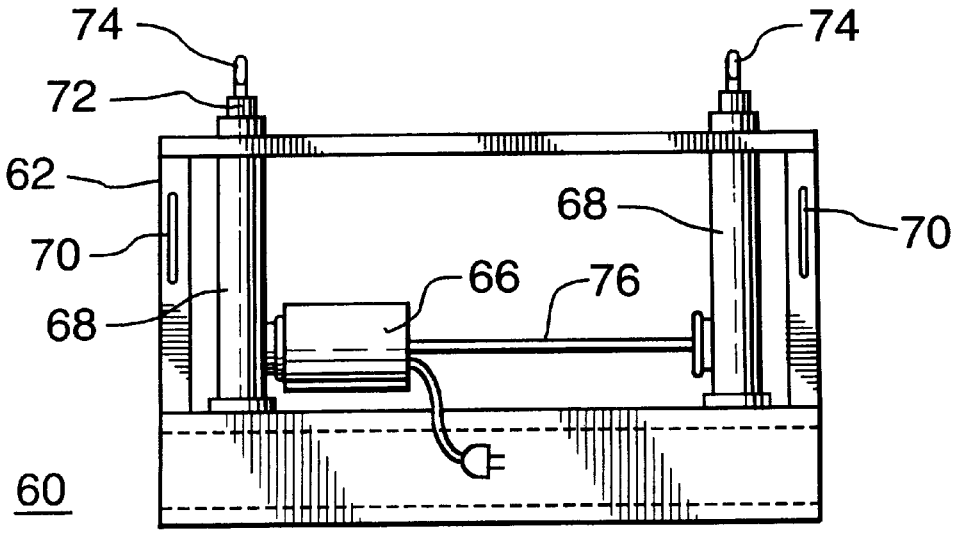

This movable U-channel 40*a* is raised or lowered by a portable glass lifting device 60, as shown in FIGS. 3*a* and 3*b*. The glass panel 6 can then be mechanically raised vertically out of the boards and then manually rotated by 90 degrees to a horizontal position. The glass 6 is then at about waist level and is then manually moved onto a cart or forklift truck. To reinstall the glass 6, the empty movable U-channel 40*a* is raised up out of the boards & rotated to a horizontal position. The glass 6 is slid horizontally into the movable U-channel 40*a*. The glass 6 is manually rotated to a vertical position. The portable lifting device 60 is then used to lower the glass 6 into the boards.

The portable glass lifting device is shown in detail in FIGS. 3*a* and 3*b*. The portable glass lifting device 60 uses a pair of screw-type actuators 68 that are powered up and down in unison by an electric motor 66. The motor 66 and the actuators 68 are commercially available from Motion Corp., Eatontown, N.J., U.S. The two actuators 68 are juxtaposed so that the lifting points are placed at a distance apart to provide some stability to the glass 6. The lifting device 60 is temporarily located to a place below each piece of glass and attached to the frame of the dasher board. The top of each actuator 68 is attached via a swivel eye 74 to the clevis 50 on the movable U-channel 40*a*. The lifting device 60 can be made to operate by manual, electrical, hydraulic or other means. The contact points with the U-channel could be one or several.

Figure 5B:
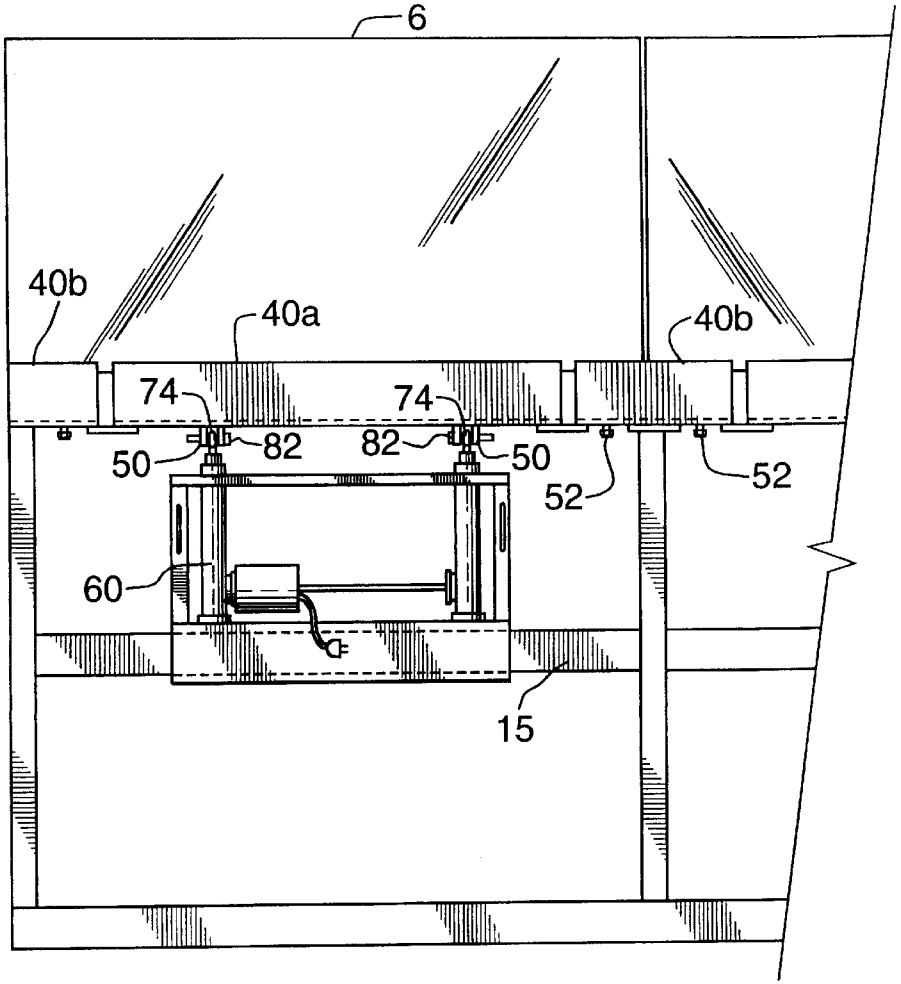
FIGS. 5*a* and 5*b* show the glass in place and the portable glass lifting device in place.
Figure 5A:
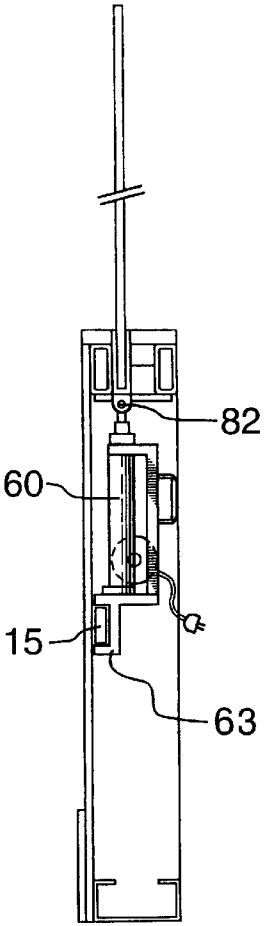

The lifting device 60 comprises a frame 62, which as shown in the side view of FIG. 3*a* comprises an open C-shaped portion 63 that is suitable for mating with the intermediate stringer 15 (see FIGS. 5*a* and 5*b*). The upper portion 65 of the frame 62 supports the actuators 68 and driving motor 66 as shown in FIG. 3*b*. A plug 64 is also shown, which of course is used with an extension cord to provide power to the motor as required. A pair of handles 70 is provided for ease of carrying of the lifting device 60. A switching mechanism (not shown) is used to switch the drive direction of the motor between lifting and retracting.

Figure 6B:
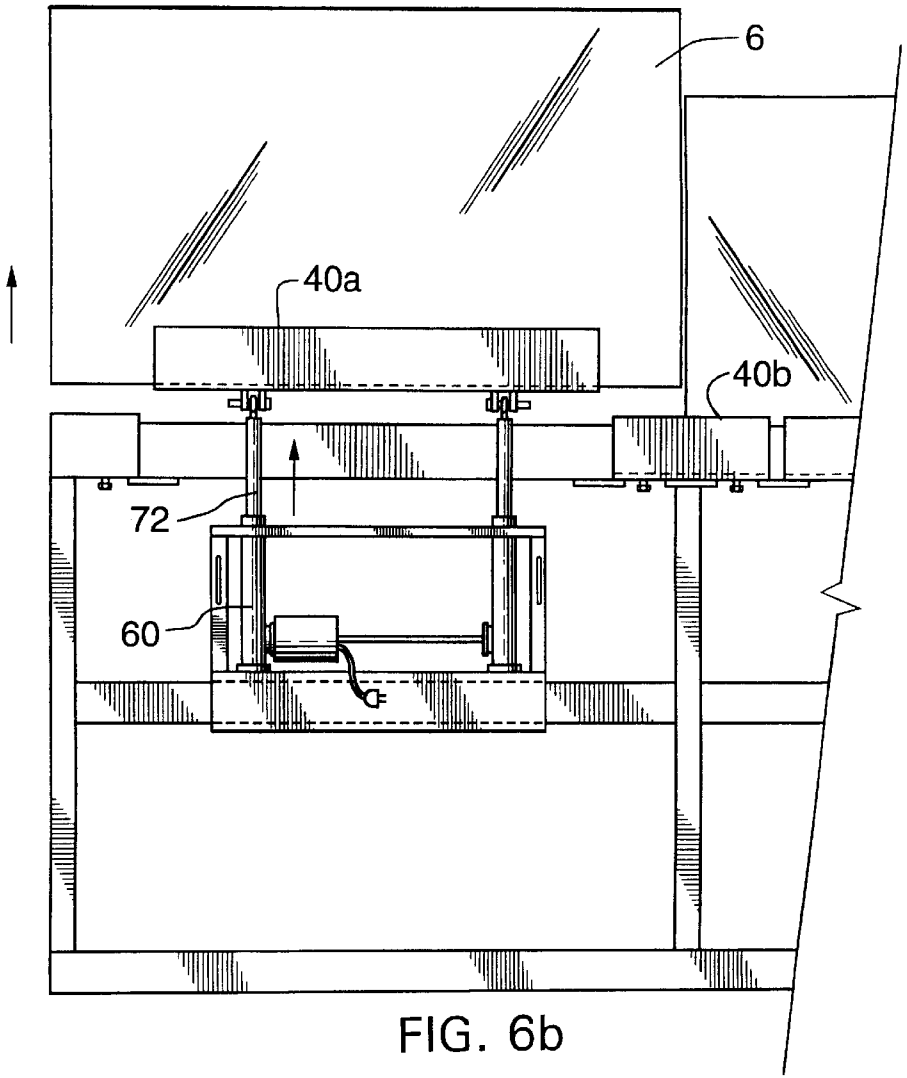
FIGS. 6*a* and 6*b* show the glass raised vertically by the actuators.
Figure 6A:
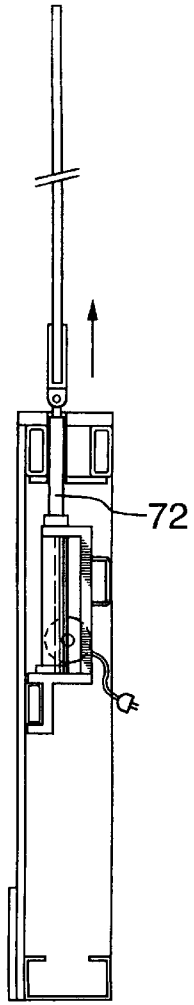

Each actuator 68, when powered, will cause an extendable shaft 72 to extend vertically therefrom (or to retract, when required). As shown in FIG. 3*a*, the actuator may provide an eight inch stroke when fully extended, which of course may vary as desired. The stroke of the actuator must be sufficient to cause the glass 6 to be fully extended from the fixed U-channel 40*b*, as shown in FIGS. 6*a* and 6*b*.

A swivel eye 74 is fixed to the end of the extendable shaft 72, which is mated with the clevis 50 by a pin 82 as shown in FIGS. 5*a* and 5*b*.

Figure 4B:
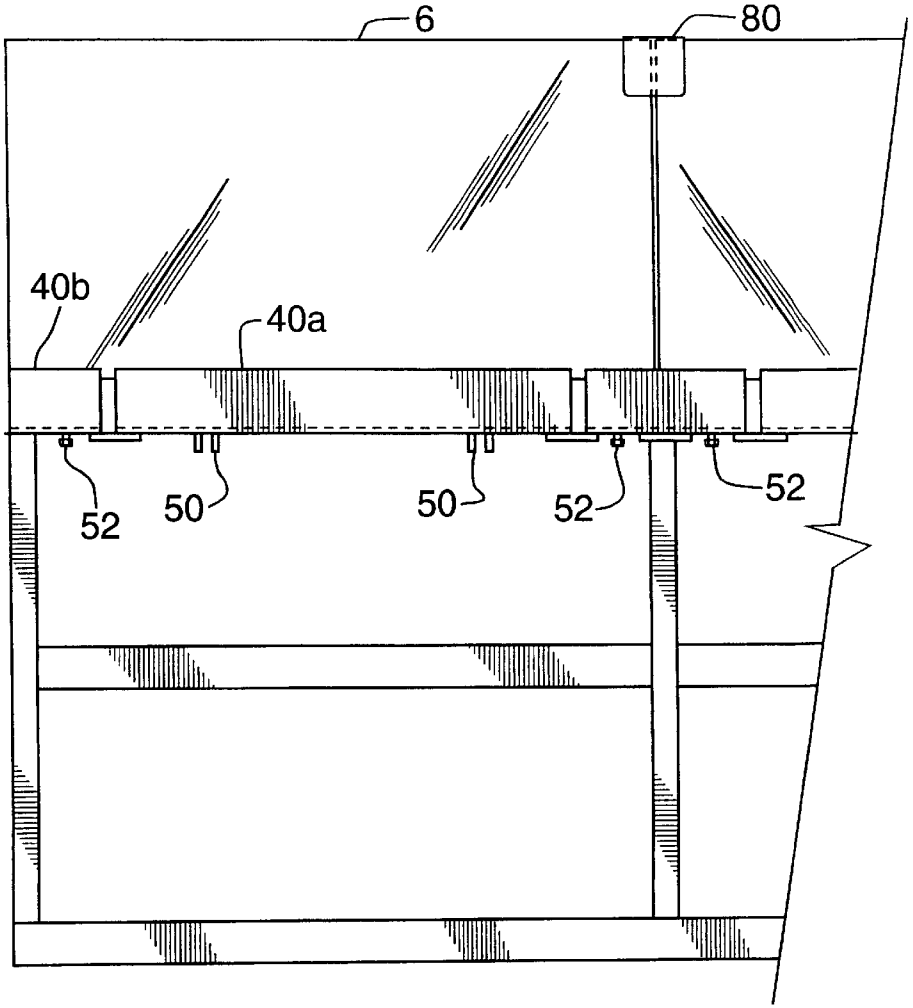
Figure 4A:
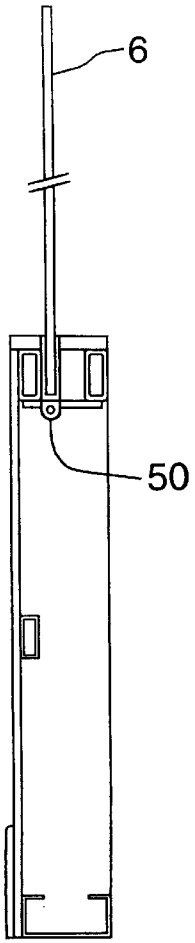

FIGS. 4*a* and 4*b* illustrate with clarity the location of the clevises 50 in relation to the movable U-channel 40*a*. Also shown is a clip 80, which is normally used to provide stability to the supportless dasher board system, and which will be removed when glass removal is desired. In addition, the cams 52 will be turned to their unbiased or released state so that the glass will be able to be removed from the fixed U-channel 40*b*.

FIGS. 5*a* and 5*b* illustrate the placement of the lifting device 60 onto the intermediate stringer 15. The C-shaped frame portion 63 is located onto the stringer 15, so that each swivel eye 74 is centered between each pair of clevises 50, and a pin 82 is inserted through this assembly to provide the appropriate pivot axis. The clip 80 is shown removed so the glass may now be removed.

Figures 7A, 7B:
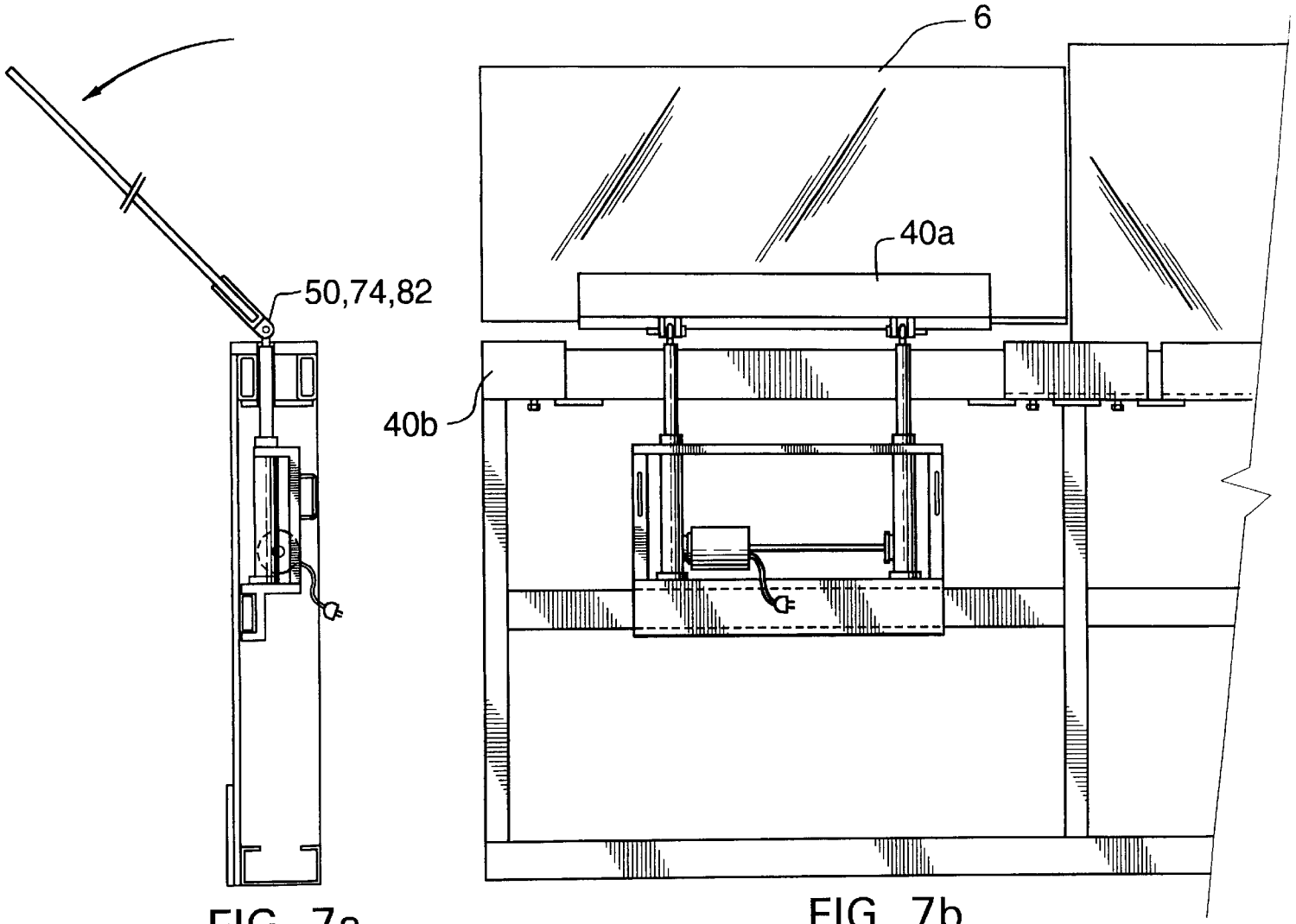
FIGS. 7*a* and 7*b* show the glass manually rotated towards the horizontal position.
Figure 8B:
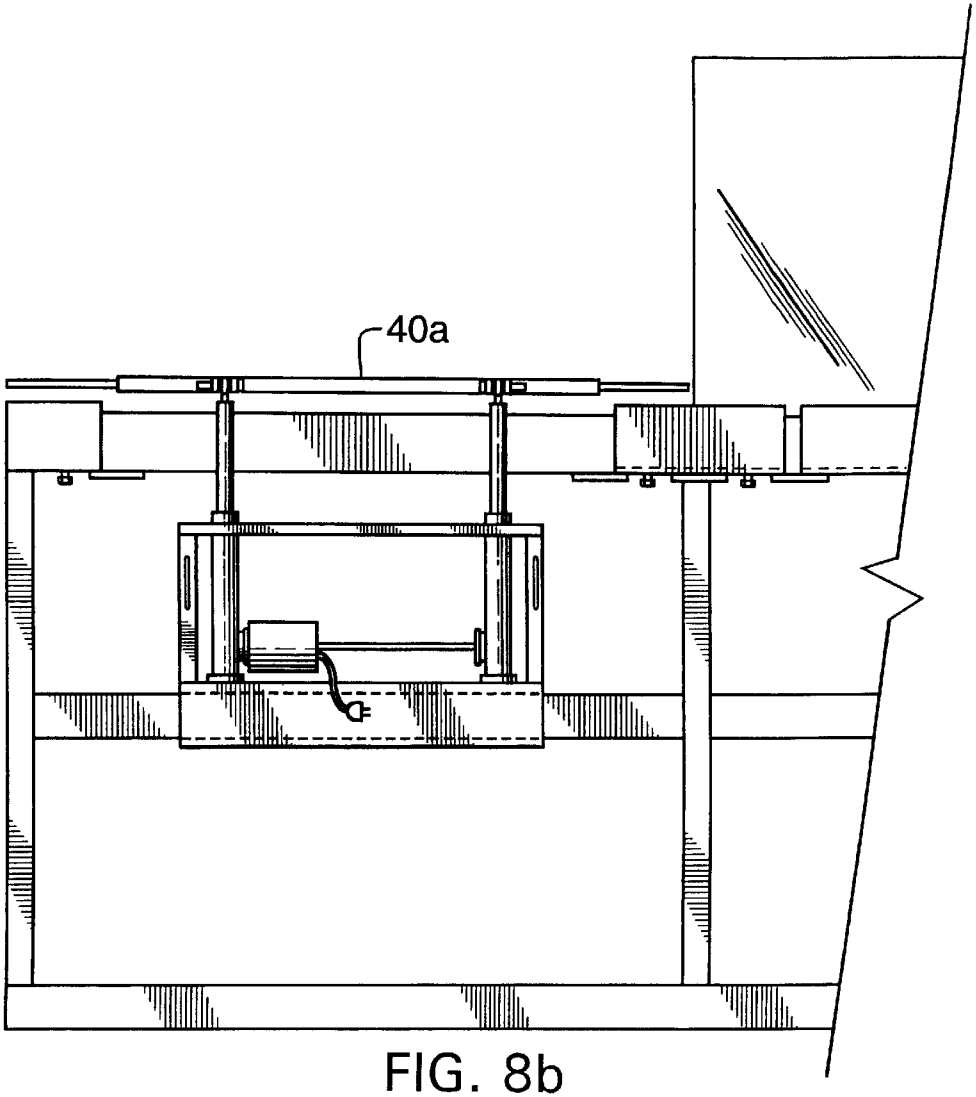
FIGS. 8*a* and 8*b* show the glass manually removed from the U-channel to be placed on skid or forklift truck.
Figure 8A:
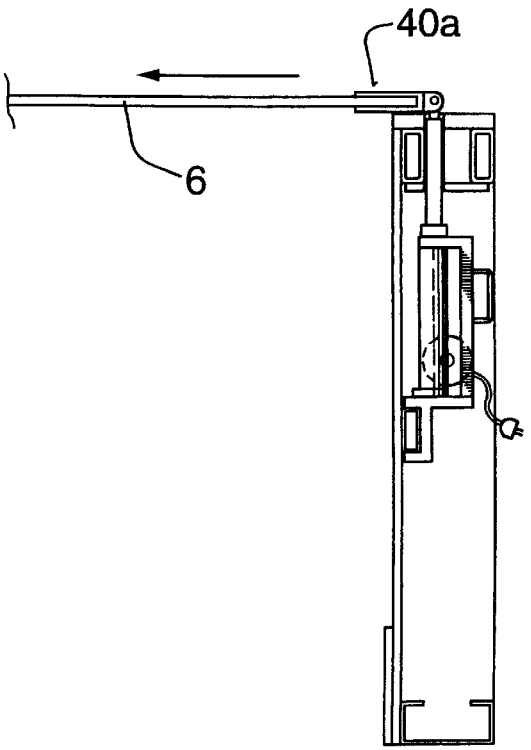
Figure 9:
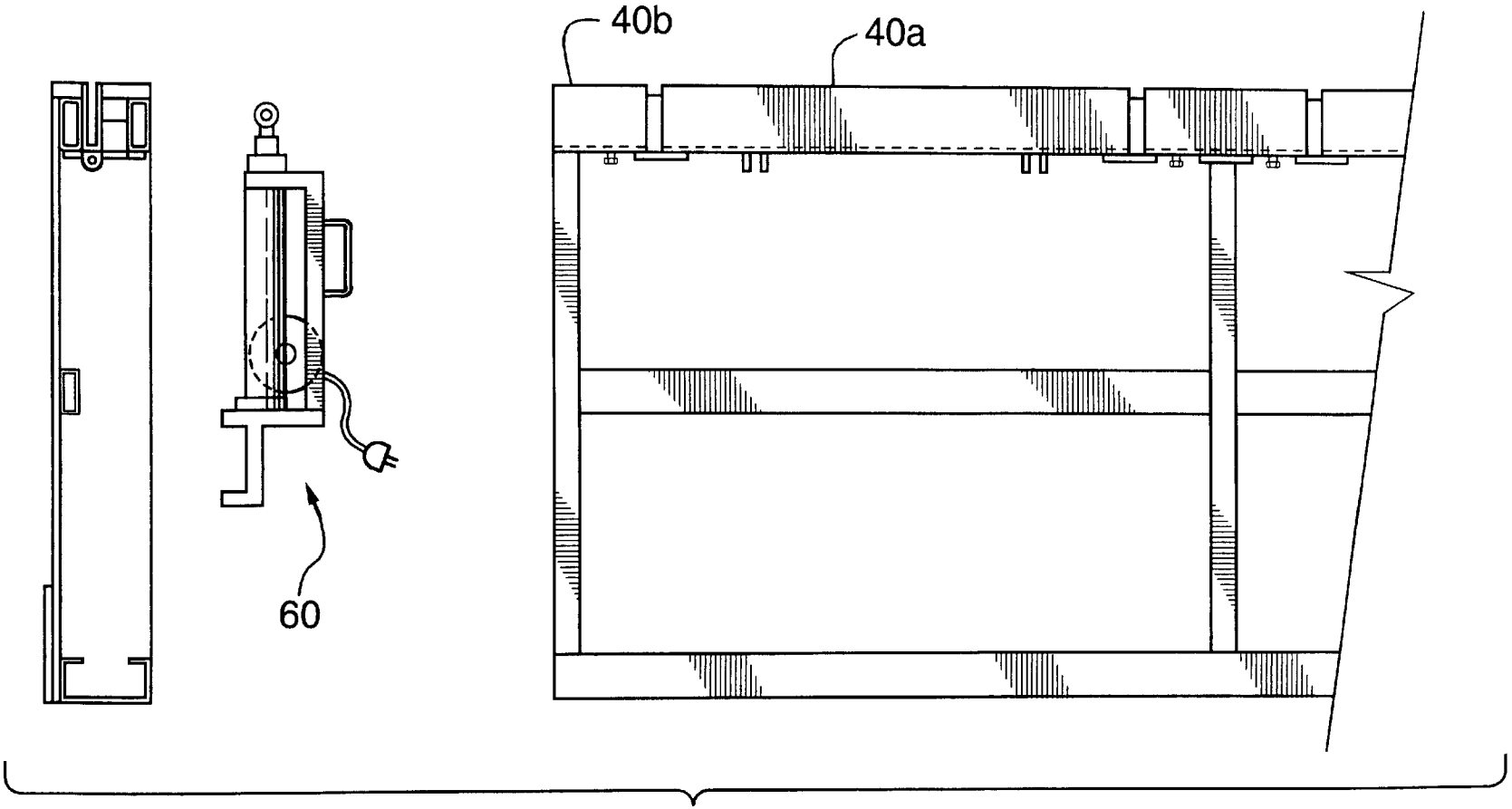

By providing power to the motor 66 through the plug 64, the actuators will be engaged via means well known in the art (i.e. by a gear assembly or the like), and the extendable shaft 72 will be caused to rise as shown in FIGS. 6*a* and 6*b*. this will cause the movable U-channel 40*a* to rise out of its alignment with the fixed U-channel 40*b*, thus causing the entire glass panel 6 to also rise. Once the glass has cleared the fixed U-channel 40*b*, it may be allowed to pivot about the pins 82 away from the boards, as shown in FIGS. 7*a* and 7*b*. Of course, it will be necessary for one or two operators to help guide the rotation of the glass 6 once it has cleared the fixed U-channel 40*b*. Once the glass has been rotated to about a 90 degree angle, it may be easily removed out of the movable U-channel 40*a*, as shown in FIGS. 8*a* and 8*b*, and placed on a forklift truck or the like for storage as desired. The movable U-channel 40*a* can then be rotated back to its vertical position, and the drive direction of the motor reversed so that the shafts 72 will retract and the movable U-channel 40*a* is placed back to its normal position, aligned with the fixed U-channel 40*b* as shown in FIG. 9. The lifting device 60 can then be removed and used with the adjoining board assembly. Since the lifting device has been designed to be easily removable, only one such device is required to effect glass removal (and installation) for an entire hockey rink assembly.

The glass installation process is simply the reverse of the removal process described herein.

Alternative embodiments exist to the illustrated U-channel described above. Thus, the U-channel may be made all movable instead of part fixed & part movable. The U-channel may be made of two separate halves that can clamp on the glass. The U-channel could be made to open & close as it is raised & lowered respectively. The U-channel could be made to "float" so there is movement when a player hits the glass. The U-channel could also consist of the whole top part of the dasher board that is hinged to rotate to a horizontal position. The U-channel could be set in guides to control its movement. The lifting device and U-channel can be arranged so that the glass is raised vertically and automatically rotated to the horizontal position by power from the glass lifting device. The glass could also be automatically rotated from the horizontal to the vertical position. The glass could also be automatically released from or pulled into the U-channel.

We claim:

1. A dasher board system comprising:

a. a dasher board frame assembly;

b. a channel assembly for receiving a shielding panel, said channel assembly comprising a movable channel aligned for holding the shielding panel therewithin; and c. means for lifting the movable channel out of the dasher board frame assembly;

whereby a shielding panel held within the channel assembly will be lifted along with the movable channel.

2. The dasher board system of claim 1 wherein said means for lifting the movable channel is pivotably joined to the movable channel; whereby the movable channel is rotatable with respect to the dasher board assembly when the shielding panel has been completely lifted out of the dasher board frame assembly.

3. The dasher board system of claim 2 wherein said means for lifting the movable channel is pivotably joined to the movable channel by a pivoting assembly comprising:

a. a clevis assembly located on an underside portion of the movable channel;

b. a swivel eye located on an upper portion of the means for lifting the movable channel; and c. a pin inserted through an axis formed by the alignment of the clevis assembly and the swivel eye.

4. The dasher board assembly of claim 1 wherein said means for lifting the movable channel is selectively removable from the dasher board assembly.

5. The dasher board assembly of claim 4 wherein said dasher board frame assembly comprises an intermediate stringer extending laterally therealong, and wherein said means for lifting the movable channel has a substantially C-shaped frame portion for removable placement on the intermediate stringer.

6. The dasher board assembly of claim 3 wherein said means for lifting the movable channel comprises a motor and a pair of actuator assemblies interconnected thereto, each of the actuator assemblies comprising an extendable shaft having a retracted position substantially contained within the actuator and an extended position, the motor interacting with the actuators to selectively drive the extendable shaft between the retracted position and the extended position, the actuators comprising the swivel eye at an end thereof.

7. A dasher board system comprising:

a. a dasher board frame assembly;

b. a channel assembly for receiving a shielding panel, said channel assembly comprising a fixed channel and a movable channel, said fixed channel being affixed to the dasher board frame assembly and comprising means for releasably clamping the shielding panel therewithin, said movable channel aligned with said fixed channel so as to provide a substantially contiguous channel assembly for holding the shielding panel therewithin; and c. means for lifting the movable channel with respect to the fixed channel; whereby a shielding panel held within the channel assembly will be lifted along with the movable channel and out of the fixed channel when the means for releasably clamping the shielding panel is in an unbiased position.

8. The dasher board system of claim 7 wherein said means for lifting the movable channel is pivotably joined to the movable channel; whereby the movable channel is rotatable with respect to the dasher board assembly when the shielding panel has been completely lifted out of the fixed channel.

9. The dasher board system of claim 8 wherein said means for lifting the movable channel is pivotably joined to the movable channel by a pivoting assembly comprising:

d. a clevis assembly located on an underside portion of the movable channel;

e. a swivel eye located on an upper portion of the means for lifting the movable channel; and f. a pin inserted through an axis formed by the alignment of the clevis assembly and the swivel eye.

10. The dasher board assembly of claim 7 wherein said means for lifting the movable channel is selectively removable from the dasher board assembly.

11. The dasher board assembly of claim 10 wherein said dasher board frame assembly comprises an intermediate stringer extending laterally therealong, and wherein said means for lifting the movable channel has a substantially C-shaped frame portion for removable placement on the intermediate stringer.

12. The dasher board assembly of claim 9 wherein said means for lifting the movable channel comprises a motor and a pair of actuator assemblies interconnected thereto, each of the actuator assemblies comprising an extendable shaft having a retracted position substantially contained within the actuator and an extended position, the motor interacting with the actuators to selectively drive the extendable shaft between the retracted position and the extended position, the actuators comprising the swivel eye at an end thereof.

* * * * *